United States Patent [19]

Stryker et al.

[11] Patent Number: 4,987,623

[45] Date of Patent: Jan. 29, 1991

[54] HOSPITAL STRETCHER HAVING PATIENT TRANSFER DEVICE AND SIDE RAILS WITH HANDLE PORTIONS

[75] Inventors: Martin W. Stryker, Kalamazoo Township, Kalamazoo County; Thomas W. Fennell, Portage, both of Mich.

[73] Assignee: Stryker Corporation, Kalamazoo, Mich.

[21] Appl. No.: 470,855

[22] Filed: Jan. 26, 1990

[51] Int. Cl.[5] ..... A61G 1/02; A47C 21/08

[52] U.S. Cl. ..... 5/86; 5/81 B; 5/185; 5/430

[58] Field of Search ..... 5/81 R, 81 B, 86, 181, 5/185, 425, 427–430

[56] References Cited

U.S. PATENT DOCUMENTS

| | | | |
|---|---|---|---|
| 3,195,153 | 7/1965 | Armstrong et al. | 5/430 |
| 3,344,445 | 10/1967 | Crawford | 5/81 B X |
| 4,011,609 | 3/1977 | Bethlen . | |
| 4,012,799 | 3/1977 | Rutherford . | |
| 4,222,132 | 9/1980 | Crim et al. | 5/86 X |
| 4,761,841 | 8/1988 | Larsen . | |
| 4,839,933 | 6/1989 | Plewright et al. | 5/81 R |
| 4,873,732 | 10/1989 | Perez | 5/81 B |

FOREIGN PATENT DOCUMENTS

| | | | |
|---|---|---|---|
| 2068850 | 8/1981 | United Kingdom | 5/81 B |

OTHER PUBLICATIONS

Surgicraft HTF Stretcher; Excerpt from Hamilton Industries Marketing Brochure (2 pages).

Totalift Stretcher; Excerpt from WY[1] East Medical Marketing Brochure (2 pg.).

MLA Mobilizer Stretcher; Medical Laboratory Automation, Inc., Marketing Brochure (2 pages).

Easy-Lift Stretcher; Excerpt from Hausted Marketing Brochure (1 page).

Patient-Mover Stretcher; T.B.S., Inc. Marketing Flyer (1 page).

Maquet Stretcher; Excerpt from Descriptive Document (1 page).

Tomac Surgilift II Stretcher; Excerpt from American Hospital Supply Catalogs (2 pages).

PAL Patient Lift; "Transport Patients More Quickly"; Health Care Systems, p. 6.

*Primary Examiner*—Michael F. Trettel

*Attorney, Agent, or Firm*—Flynn, Thiel, Boutell & Tanis

[57] ABSTRACT

A hospital stretcher includes an upwardly facing patient support surface and side rails on each side of the surface movable between raised and collapsed positions. Each side rail has at one end a spindle with a handle portion which, in the raised position, extends downwardly and away from the side rail. In the collapsed position, the top of each side rail is disposed below the support surface on the stretcher. The stretcher has on each side thereof a patient transfer mechanism, each transfer mechanism including a support board which can, from a retracted position disposed lower than the patient support surface, move upwardly between the support surface and one side rail in a vertical orientation and then pivot 90° to a horizontal orientation in which a surface thereon is level with the patient support surface and in which an underside of one edge portion of the support board rests on top of the collapsed side rail.

29 Claims, 4 Drawing Sheets

HOSPITAL STRETCHER HAVING PATIENT TRANSFER DEVICE AND SIDE RAILS WITH HANDLE PORTIONS

FIELD OF THE INVENTION

The present invention relates to a mobile stretcher for use in a hospital and, more particularly, to such a stretcher having an integral patient transfer device and having side rails which facilitate manual maneuverability of the stretcher.

BACKGROUND OF THE INVENTION

During use of a mobile stretcher in a hospital, it is frequently necessary to transfer a patient from the stretcher to another stretcher (or a bed or X-ray table), or vice versa. In some cases, this is done by simply positioning the two stretchers side by side and then having several persons physically lift and slide the patient from one stretcher to the other. This is dangerous to the patient, because the patient may be dropped on the floor between the stretchers. Further, it is dangerous to hospital personnel, because it is a common source of serious back injuries.

Devices have been developed to facilitate patient transfers, but they are often special devices which are separate from a stretcher and which may be lost or at least not readily available when it is necessary to effect a patient transfer. Also, some devices require electricity from a wall outlet, and there may not always be a wall outlet handy when a patient transfer must be made. One known stretcher has an arrangement which can serve both as a side rail and as a patient transfer device, but it is relatively bulky and cumbersome to operate, and in particular cannot be easily moved into a transfer position once two stretcher have been placed in a side by side relationship unless the positions of the stretchers are physically jockeyed.

A related source of back injury for hospital personnel grows out of manually maneuvering stretchers. In particular, a person maneuvering a stretcher usually stands at one end of the stretcher. The typical stretcher has no handles at either end. Thus, to grasp the end of the bed, the person must lean over, which presents a risk of back injury. While it would be possible to use a conventional mechanism of the stretcher to raise the vertical height of the mattress support frame and thus the patient, this raises the center of gravity and thus reduces the stability of the stretcher, presents an increased risk of danger to the patient due to the added height, and also reduces the patient's sense of security.

On the other hand, most stretchers do have collapsible side rails located on each side of the mattress. When the side rail is in a raised position, it has a horizontally extending top rail and a number of spaced spindles which extend vertically downwardly from the top rail. The person who wishes to maneuver the stretcher can lean over the stretcher and grasp either an end spindle of each side rail or the top rail of each side rail. However, the vertical spindle and horizontal top rail are not convenient to grasp, which forces the person to lean farther than is desirable and thus increases the risk that a back injury may result while the stretcher is being maneuvered. Further, since it is customary for the person to stand at the end of the bed corresponding to the head of the patient, the person and the patient may breathe on each other while the person is leaning over the patient, and thus if either has an infectious disease it may be transferred to the other.

It is therefore an object of the present invention to provide a patient transfer arrangement which is an integral part of a stretcher, which is compact, and which does not require electricity.

It is a further object of the invention to provide such a patient transfer arrangement which can be easily operated by one person, and which can be operated when two stretcher are in a side by side relationship without any need to jockey the positions of the stretchers.

It is a further object of the invention to provide an arrangement which makes it easy for a person to maneuver the stretcher while minimizing the extent to which the person must lean forwardly over the stretcher, in order to thereby reduce the risk of injury to such person.

SUMMARY OF THE INVENTION

The objects and purposes of the invention, including those set forth above, are met according to a first form of the present invention by providing an apparatus which includes a vehicle having an upwardly facing surface, a support member having thereon a support surface, and a support arrangement supporting the support member on the vehicle for movement between a retracted position in which the support member is disposed lower than the surface on the vehicle and an operational position in which the support member is disposed in the region of an edge portion of the surface on the vehicle and is oriented so that the support surface thereon is facing upwardly and is at approximately the same vertical level as the surface on the vehicle. The support surface includes a portion which in the operational position is disclosed horizontally outwardly beyond the edge portion of the surface on the vehicle, and as the support member moves from its retracted position to its operational position it moves upwardly adjacent the edge portion of the surface on the vehicle with its support surface oriented to extend approximately vertically.

A different form of the invention involves the provision of a vehicle having an upwardly facing surface, a support member having a support surface, and a support arrangement cooperable with an edge portion of the support member to support it, the support arrangement facilitating movement of the support member between a retracted position in which the support member is disposed vertically lower than the surface on the vehicle and an operational position in which the edge portion of the support member is adjacent an edge portion of the surface on the vehicle and the support surface on the support member is substantially horizontal, faces upwardly, and extends from the edge portion of the support member horizontally outwardly away from the edge portion of the surface on the vehicle.

A different form of the present invention involves the provision of a vehicle having thereon an upwardly facing surface, and having first and second side rails which are provided on opposite sides of the surface and which project upwardly beyond the surface, each side rail having at one end a handle portion which can be manually gripped and which is inclined to extend downwardly and away from the side rail.

BRIEF DESCRIPTION OF THE DRAWINGS

Two preferred embodiments of the present invention are disclosed in detail hereinafter with reference to the accompanying drawings, in which.

DETAILED DESCRIPTION

Figure 1:
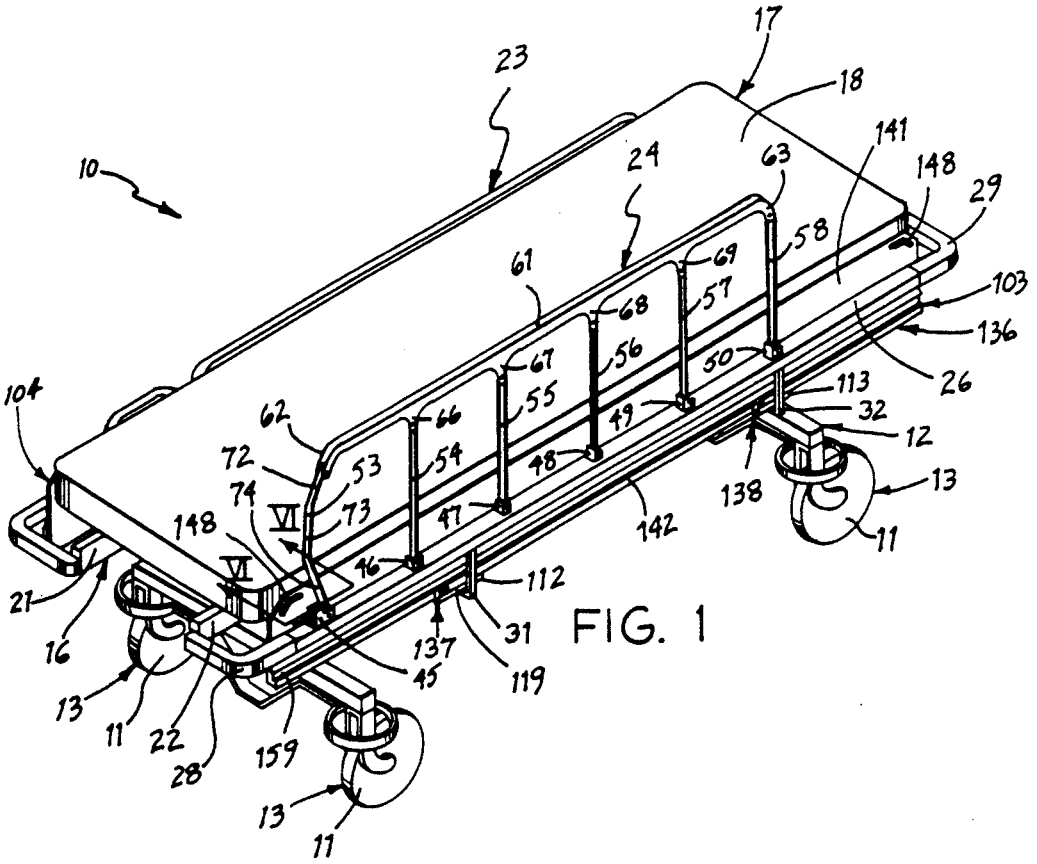
FIG. 1 is a perspective view of a hospital stretcher which embodies the present invention.

Referring to FIG. 1, a vehicle 10 which embodies the present invention is a hospital stretcher movably supported by wheels 11. The vehicle 10 includes a conventional base 12 supported on four caster assemblies 13 which each include a respective one of the wheels 11. The base 12 supports a metal frame 16, which in turn supports a conventional mattress having an upwardly facing support surface 18 on which a patient can be placed. The base 12 preferably includes a conventional mechanism which is not illustrated in detail and which permits the frame 16 and mattress 17 thereon to be selectively raised and lowered to different vertical heights. The frame 16 preferably includes a mattress support portion 19, on which the mattress 17 is directly supported, the mattress support portion 19 in turn being supported on two spaced and parallel metal spines 21 and 22 which extend lengthwise of the vehicle 10 substantially the full length thereof.

Figures 3, 4, 5, 6, 7, 8:
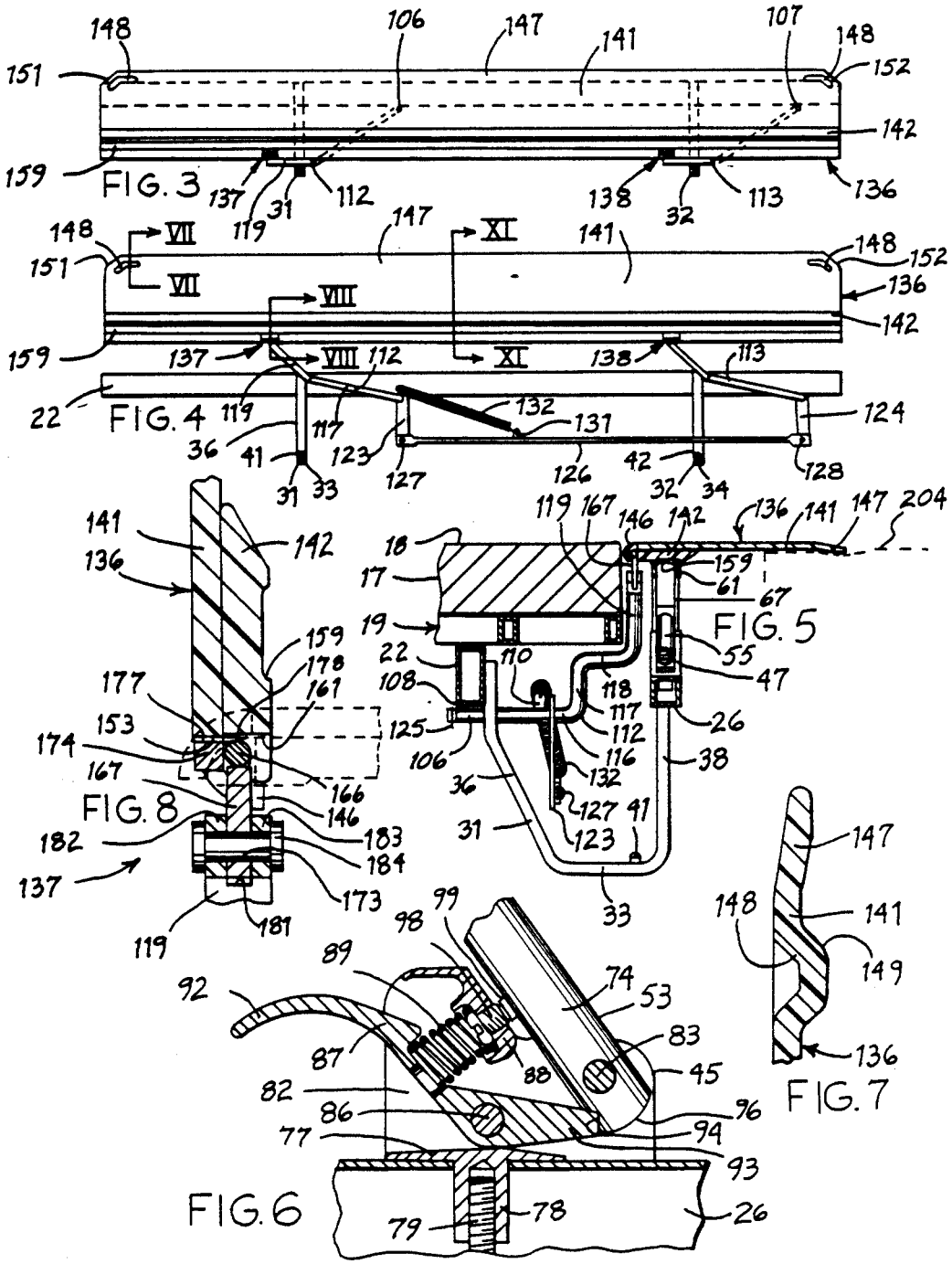
FIG. 3 is a side view of a support board mechanism which is part of the stretcher of FIG. 1.
FIG. 4 is a side view of the support board mechanism of FIG. 3 in a different operational position.
FIG. 5 is a sectional end view of the support board mechanism of FIGS. 3 and 4 in a different operational position.
FIG. 6 is a fragmentary sectional side view of a releasable locking mechanism for a collapsible side rail which is a component of the stretcher of FIG. 1.
FIG. 7 is a sectional view taken along the line VII—VII in FIG. 4.
FIG. 8 is a sectional view taken along the line VIII—VIII in FIG. 4.
Figures 9, 10:
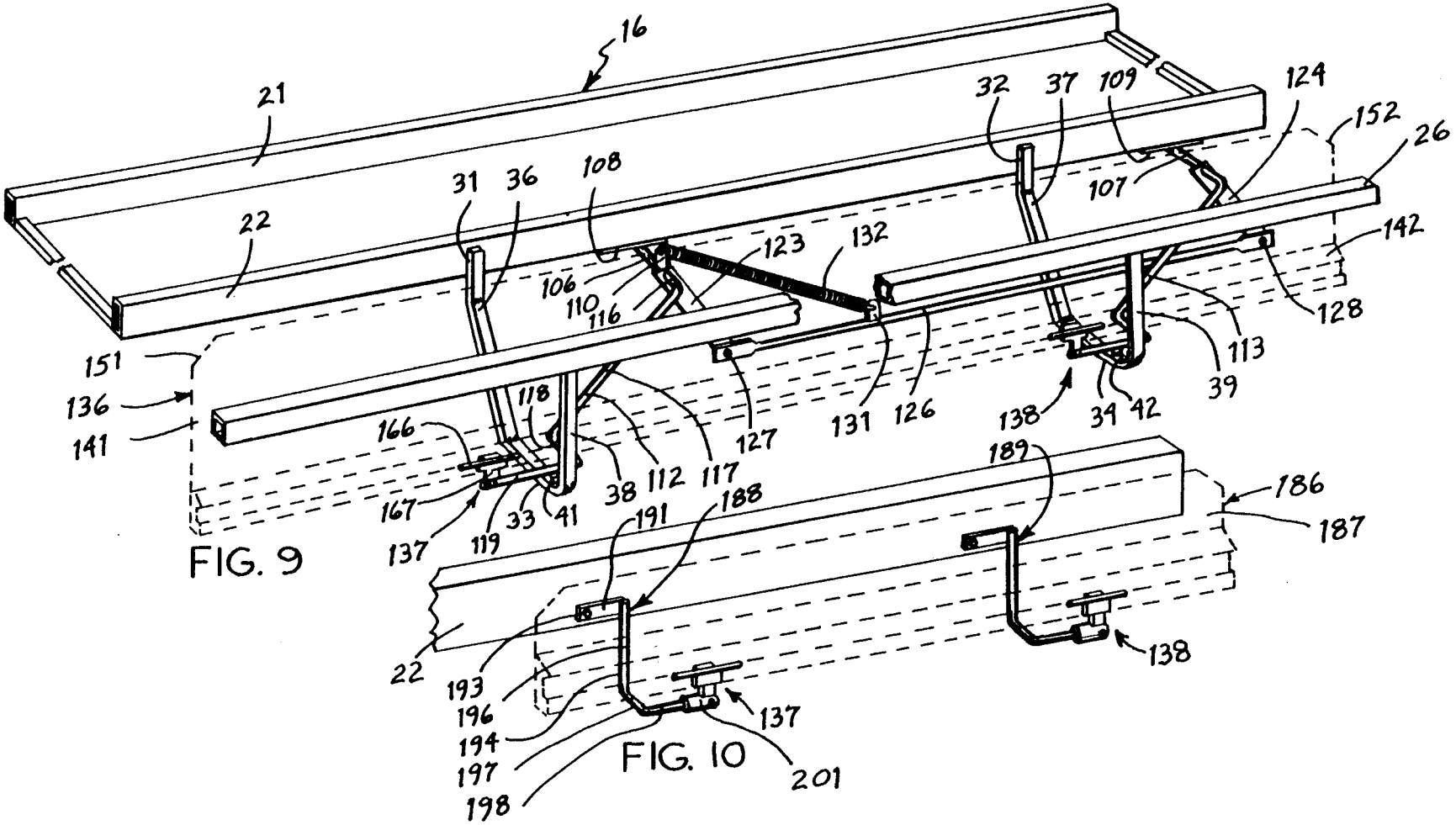
FIG. 9 is a fragmentary perspective view of selected of the stretcher of FIG. 1, certain components of the stretcher being omitted from FIG. 9 for purposes of clarity.
FIG. 10 is a perspective view similar to FIG. 9 but showing a different embodiment of the structure of FIG. 9.

The vehicle 10 has on opposites sides thereof two collapsible side rails 23 and 24. The side rails 23 and 24 are mirror images of each other, and therefore only the side rail 24 is described in detail. Referring to FIG. 1, the side rail 24 includes a metal bottom rail 26 which is spaced outwardly from and extends parallel to a side edge of the mattress 17. The ends of the bottom rail 26 are fixedly supported on the ends of the spine 22 by two end parts 28 and 29. As best seen in FIGS. 5 and 9, two U-shaped metal stirrups 31 and 32 each have a bight 33 or 34 and two legs 36 or 37 and 38 or 39 which extend upwardly from opposites ends of the bight. The upper ends of the legs 36 and 37 are fixedly secured to the spine 22, for example by welding, and the upper ends of the legs 38 and 39 are fixedly secured to the underside of the bottom rail 26, for example by welding. The bights 33 and 34 of the two stirrups 31 and 32 each have on the upper side thereof a respective plastic stop 41 or 42, for a purpose described in more detail later.

The bottom rail 26, corner parts 28 and 29 and stirrups 31 and 32 are regarded herein as parts of the frame 16. The stirrups 31 and 32 can, if desired, be eliminated, provided the corner parts 28 and 29 are sufficiently strong to rigidly support the bottom rail 26.

The side rail 24 includes six metal clevis-like spindle supports 45–50 which are secured at spaced locations to the top of the bottom rail 26, and includes six metal spindles 53–58 which each have one end pivotally supported on a respective one of the spindle supports 45–50. The side rail 24 also includes a horizontally extending metal top rail 61 which, as evident from FIG. 5, has a downwardly open U-shaped cross section, the top rail having end portions 62 and 63 which are inclined to extend downwardly and outwardly and which are each pivotally coupled at their outer ends to the upper ends of the respective spindles 53 and 58. The top rail 61 has four pairs 66–69 of downwardly projecting wall portions, each such pair having therebetween and being pivotally coupled to the upper end of a respective one of the four spindles 54–57.

Figure 2:
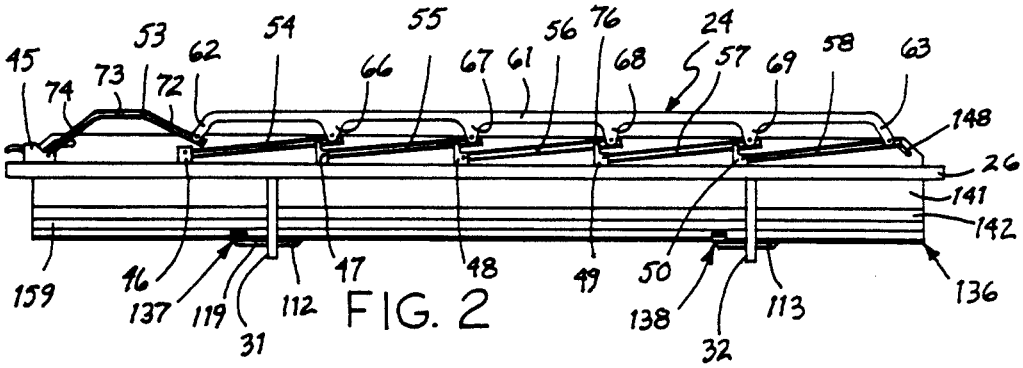
FIG. 2 is an elevational side view of an upper portion of the stretcher of FIG. 1.

The side rail 24 can move between a raised position shown in FIG. 1 in which the top rail 61 is vertically higher than the top surface 18 on the mattress 17 in order to prevent a patient from inadvertently rolling off the mattress, and a lowered or collapsed position shown in FIGS. 2 and 5 in which, as evident from FIG. 5, the top of the top rail 61 is vertically lower than the top surface 18 on mattress 17.

The five spindles 54–58 are all rectilinear, whereas the spindle 53 is bent. In particular, as shown in FIGS. 1 and 2, the spindle 53 includes a central portion 73 and includes two end portions 72 and 74 which are each bent to extend at an angle with respect to the central portion 73, the end portion 72 serving as a manually graspable handle portion to facilitate maneuvering of the vehicle 10, as described later. The portion 72 forms an angle of 25° with respect to the central portion 72 (and thus an angle of 65° with respect to the horizontal top rail 61 when the side rail 24 is raised), and the portion 74 forms an angle of 40° with respect to the central portion 73.

As shown in FIG. 2, the four spindle supports 47–50 differ from the spindle supports 45 and 46 in that each has an upward projection, one of which is shown at 76 for spindle support 49, each such projection having a semi-circular recess which receives a respective one of the four center spindles 54–57 when the side rail 24 is in the collapsed position of FIG. 2, each spindle being engaged by the associated projection at a location near its pivotal connection with the top rail. These projections on the spindle supports 47–50 precisely control the vertical level of the top rail 61 in the collapsed position of FIG. 2, and ensure that the top rail 61 does not move downwardly from this position if downward vertical forces are exerted on it in the collapsed position. The semi-circular recesses in these projections minimize any tendency of the top rail 61 to move laterally toward or away from the mattress 17 when the side rail 24 is in its collapsed position.

The bent shape of the end spindle 53 has been selected so that, as evident from FIG. 2, the central portion 73 thereof will be at substantially the same vertical level as the top rail 61 in the collapsed position of the side rail 24, for a purpose described later.

The spindle support 45 differs from the other spindle supports 46-50 in that it includes a latch mechanism for releasably locking the side rail 24 in the raised position of FIG. 1. More specifically, and referring to FIG. 6, the spindle support 45 includes a bottom wall 77 having a downward cylindrical projection 78 which extends through a hole in the top of the bottom rail 26, the projection 78 being threadedly engaged with the threaded shank of a bolt 79, the not-illustrated head of the bolt being disposed against and the shank extending through a hole in a bottom wall of the bottom rail 26. The bottom wall 77 of the spindle support 45 connects two parallel and upwardly extending side walls, only one of which is visible at 82. Two pins 83 and 86 extend transversely between and are fixedly supported on the side walls, the pin 83 extending through an opening in the lower end of the spindle 53 to effect the pivotal support of spindle 53 on spindle support 45. The pin 86 extends through an opening in and thereby pivotally supports a latch member 87. An inclined wall 88 extends between the upper ends of the side walls of the spindle support 45, and a helical compression spring 89 has one end disposed in a circular recess in the inclined wall 88 and its other end disposed in a circular recess in the latch member 87, and continuously resiliently urges counterclockwise pivotal movement of the latch member 87 in FIG. 6. The latch member 87 has a handle end 92 which can be manually lifted in order to pivot the latch member 87 clockwise against the force of the spring 89, and has a latch end 93 which can engage a notch 94 provided at one side of a rounded lower end 96 of the spindle 53. When the latch end 93 is engaging the notch 94, the spindle 53, which in FIG. 6 is in a position corresponding to the raised position of the side wall 24, is prevented from pivoting clockwise in FIG. 6, as a result of which the entire side wall 24 is maintained in the raised position. If the handle end 92 of the latch member 87 is manually lifted, the latch end 93 will move downwardly out of engagement with the notch 94, so that the spindle 53 can be pivoted clockwise in FIG. 6 and thus the side rail 24 can move from its raised position to its collapsed position. As soon as the side rail 24 has been moved a small distance away from its raised position, the manual pressure on the handle end 92 of the latch member 87 can be released, after which the spring 89 will urge the latch end 93 against the rounded end 96 of the spindle 53, and the latch end 93 will slide on the rounded end 96 as the spindle 53 pivots, until the spindle 53 is again moved to the position which is shown in FIG. 6 and which corresponds to the raised position of the side rail, at which point the spring 89 will cause the latch end 93 to snap into the notch 94 and thereby automatically latch the side rail 24 in its raised position.

The inclined wall 88 has a threaded hole which extends through it and which receives a screw 98, the outer end of the shank of the screw 98 engaging a plastic member 99 provided on the spindle 53 and thereby serving as a stop to limit counterclockwise movement of the spindle 53 in FIG. 6.

Referring to FIG. 1, the vehicle 10 has retractable support board mechanisms 103 and 104 on opposite sides of the mattress 17. The support board mechanisms 103 and 104 are mirror images but otherwise identical, and therefore only the mechanism 103 is described in detail.

Referring to FIGS. 5 and 9, the mechanism 103 includes two horizontal bearing sleeves 106 and 107 which are each welded to the underside of a respective plate 108 or 109, the plates 108 and 109 each being welded to the underside of the spine 22 at respective spaced locations therealong. The bearing sleeves 106 and 107 each extend transversely of the spine 22. The bearing sleeve 106 has fixedly welded to it an upwardly projecting metal tab 110.

The bearing sleeves 106 and 107 each pivotally support a respective board support arm 112 or 113. The supports arms 112 and 113 each have the same shape, and thus only the shape of the board arm 112 is described in detail. More specifically, referring to FIGS. 5 and 9, the arm 112 is a bent cylindrical rod having at one end a pivot portion 116 which is rotatably disposed in the bearing sleeve 106. The rod 112 has a portion 117 which extends radially away from the portion 116, an axially extending portion 118 which is at the outer end of the portion 117 and extends approximately parallel to the pivot portion 116, and an end portion 119 which extends outwardly from the portion 118 substantially perpendicular to the portion 118. The portions 117 and 119 lie in respective planes which are parallel to each other and perpendicular to the portion 118, the portions 117 and 119 being skewed with respect to each other.

A metal plate 123 is fixedly welded to and extends radially outwardly from the pivot portion 116, and a plate 124 is welded to the other support arm 113 in a similar manner. The plates each engage one end of the associated bearing sleeve 106 or 107 in order to prevent movement of the pivot portion of the associated arm in one axial direction, and axial movement of the pivot portion in the opposite direction can be prevented in any convenient manner, for example by the snap ring shown at 125 in FIG. 5, or by a cotter pin.

An elongate link rod 126 has flattened ends which are pivotally coupled by rivets at 127 and 128 to the radially outer ends of the respective plates 123 and 124. The rod 126 has an upwardly extending tab 131 welded to it, and a helical compression spring 132 has its ends respectively supported by the tab 110 on sleeve 106 and the tab 131 on rod 126. The spring 132 resiliently urges the rod 126 leftwardly in FIG. 9, which in turn urges the support arms 112 and 113 to pivot clockwise in FIG. 9.

Figure 11:
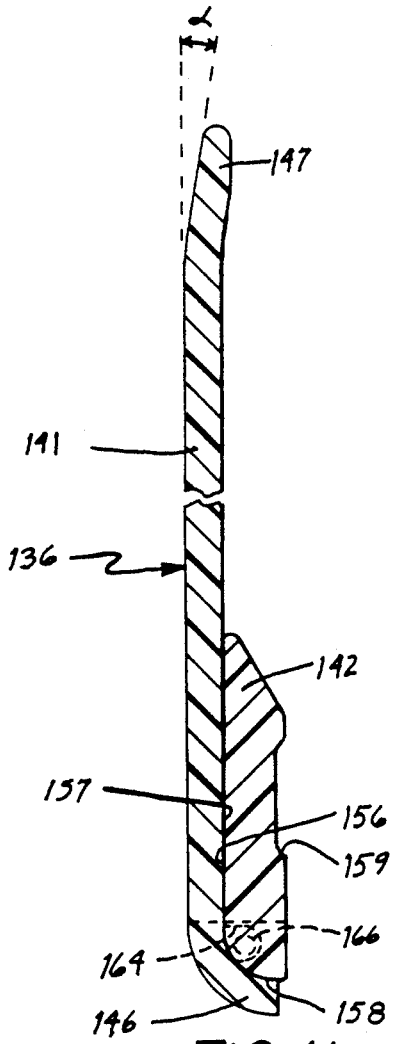
FIG. 11 is a sectional view taken along the line XI—XI in FIG. 4.

Referring to FIGS. 1, 3 and 4, the support board mechanism 103 further includes a support board 136 which is coupled by two pivot assemblies 137 and 138 to the ends of the respective board support arms 112 and 113. The support board 136, as shown in FIG. 11, includes a main board part 141 and a reinforcing board part 142, which are each preferably made of ABS (acrylonitrile-butadiene-styrene). The main board part 141 has an elongate, approximately rectangular shape, as shown in FIG. 3. The main board part 141 is approximately flat except that, as shown in FIG. 11, one side edge portion 146 has a small amount of curl, and the opposite side edge portion 147 is bent to extend at an acute angle $\alpha$ with respect to the flat central portion of the board, the angle $\alpha$ being approximately 10°. Referring to FIGS. 4 and 7, the main board part 141 has near each of two corners a finger groove 148, and on the opposite side of the main board part, in alignment with the finger grooves 148, are respective finger ridges 149. As shown in FIG. 4, two corners of the main board part 141 near the finger grooves 148 are angled at 151 and 152. In the region of each of the pivot assemblies 137 and 138, the main board part 141 has a rectangular recess extending into the edge portion 146, one of these recesses being shown at 153 in FIG. 12.

The reinforcing board part 142 is approximately the same length as the main board part 141, but is not as wide. As shown in FIG. 11, the reinforcing board 142 is located adjacent the edge portion 146 of the main board part 141, and has a surface 156 on one side thereof which is disposed against the surface 157 on the main board part 141, the surface 156 being rounded at 158 to conform to the rounded portion of surface 157 caused by the curled edge portion 146 of board part 141. The board parts 141 and 142 are fixedly secured to each other by a conventional adhesive and/or ultrasonic welding. The board part 142 has a shallow groove 159 extending the full length thereof on a side thereof opposite from the main board part 141, the shallow groove 159 having a width slightly greater than the width of the top rail 61 of side rail 24.

Figure 12:
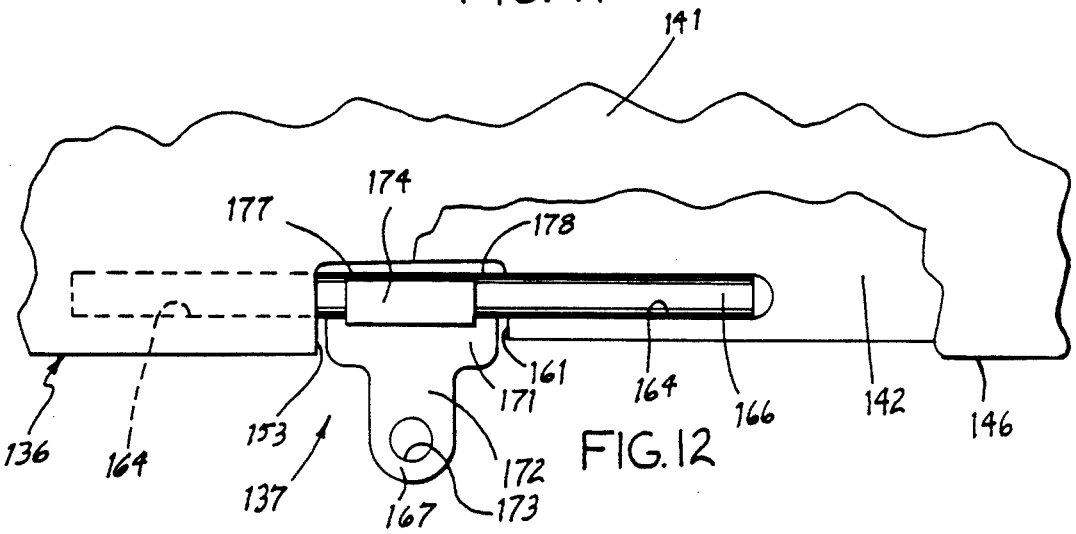
FIG. 12 is a fragmentary side view of a support board and pivot assembly which are components of the support board mechanism shown in FIGS. 3 and 4.

Extending into the reinforcing board part 142 from the rounded edge portion 158 thereof are two rectangular recesses, one of which is shown at 161 in FIG. 12, the two rectangular recesses in board part 142 each being aligned with a respective one of the rectangular recesses in 153 in main board part 141. The surface 156 of board part 142 has in the region of each rectangular recess 161 two grooves 164, which as shown in FIG. 12 communicate with and extend in opposite directions away from the rectangular recess 161. As shown in FIGS. 8 and 12, the pivot assembly 137 includes an elongate cylindrical pin which has a length substantially greater than the width of the rectangular recesses 153 and 161, and has each of its end portions disposed in a respective one of the grooves 164. Once the board parts 141 and 142 are adhesively secured together, the surface 157 on board part 141 maintains the pin 166 in the grooves 164, as evident from FIG. 11.

The pivot assembly 137 also includes a plate 167 which has an upper edge disposed against and welded to the underside of pin 166, the upper portion 171 of plate 167 closest to the pin 166 having a width which is slightly less than the width of the rectangular recesses 153 and 161 in the board parts 141 and 142, and a lower portion 172 of plate 167 having a width which is about half the width of the upper portion 172. The portion 172 has a circular hole 173 extending through it. A rectangular metal stop 174 of square cross section is disposed against one side of the pin 166 so as to extend parallel thereto, and is welded to the pin 166. The length of the pin 174 is less than the width of the portion 171 of plate 167 but greater than the width of portion 172 of plate 167. Referring to FIGS. 8 and 12, the top surface 177 of the stop 174 is slightly lower than the top 178 of pin 166.

The end portion 119 of support arm 112 has a slot 181 (FIG. 8) extending into it and defining two spaced wall portions 182 and 183. The lower portion 172 of plate 167 is disposed between the wall portions 182 and 183, and a pivot pin or rivet 184 extends through aligned openings in the wall portions 182 and 183 and through the hole 173 in the plate 167, thereby effecting a pivotal support of the plate 167 on the end portion 119 of support arm 112. The pin 184 extends parallel to the pivot portion 116 of arm 112.

The pivot assembly 138 is identical to the pivot assembly 137, and the manner in which the pivot assembly 138 cooperates with the support board 136 and support arm 113 is the same as described above for pivot assembly 137. Therefore, pivot assembly 138 is not described in detail.

FIG. 10 discloses a support board mechanism 186 which is an alternative embodiment of the support board mechanism 103 of FIG. 1. The embodiment of FIG. 10 includes a collapsible side rail like the side rail 24 shown in FIG. 1, but the side rail has been omitted from FIG. 10 for clarity. Components which are identical to those in the embodiment of FIG. 1 are designated in FIG. 10 with the same reference numerals used in the embodiment of FIG. 1. Only the differences are discussed in detail below.

The support board mechanism 186 shown in FIG. 10 includes a support board 187 coupled by two pivot assemblies 137 and 138 to two support arms 188 and 189 which movably support the board 187 on the spine 22. The pivot assemblies 137 and 138 are identical to those in the embodiment of FIG. 1, and are therefore not discussed in detail. The support board 187 differs from the support board 136 of FIG. 1 only in that it is about half as long and two-thirds as wide. The primary difference between the embodiment of FIG. 10 and the embodiment of FIG. 1 is the structure of the support arms 188 and 189, and the manner in which they are pivotally supported on the spine 22. The support arms 188 and 189 are identical, and therefore only the support arm 188 is described in detail.

The support arm 188 includes an elongate rectangular metal plate 191 which is pivotally supported at one end on the spine 22 by a bolt 193, which extends horizontally through aligned openings in the plate 191 and the spine 22. The opposite end of the plate 191 is welded to an end of a bent rod 194. The rod 194 includes an end portion 196 which extends away from the plate 191 perpendicular thereto, a central portion 197 which extends approximately parallel to the bolt 193, and an end portion 198 which extends approximately perpendicular to the central portion 197. A fitting 201 is fixedly welded to the outer end of the portion 198 of rod 194, and the pivot assembly 137 is pivotally coupled to the fitting 201 in substantially the same way that the fitting 137 in FIG. 8 is coupled to the end 119 of arm 112.

OPERATION

Referring to FIG. 1, when the support board mechanisms 103 and 104 are each in the retracted positions shown in FIG. 1, the side rails 23 and 24 can be placed in their raised positions, each being held in the raised position by the latch mechanism in the respective spindle support 45. In this position, the handle portion 72 of the end spindle 53 of each side rail can be manually grasped by a respective hand of a person, and used to manually maneuver the wheeled vehicle 10. Each handle portion 72 is at a vertical height and at an angle which make it comfortable for a person standing next to the end of the bed to grasp each handle portion 72. The spindles 53 are close enough to the end of the bed so that the person does not have to lean over the bed, which reduces the risk of a back injury and the extent to which the person and any patient on the bed may tend to breathe on the other and thereby spread a contagious disease.

Turning to the support board mechanisms 103 and 104 in FIG. 1, their operation is substantially identical, thus only the operation of the support board mechanism 103 will be described in detail. An important function of the support board mechanism 103 is to facilitate the transfer of a patient between the vehicle 10 and another vehicle or a bed. To effect such a transfer, the vehicle 10 is placed next to the other vehicle or bed. Then, the level of the surface 18 of the vehicle 10 is adjusted to be at the same height as the patient support surface on a mattress 204 (FIG. 5) of the adjacent vehicle or bed, using the conventional (and not illustrated) height adjustment mechanism present in the vehicle base 12. Then, with the side rail 24 in the collapsed position of FIG. 2, the finger groove 148 and/or finger ridge 149 at one end of the support board 136 is manually gripped and used to raise the board vertically upwardly from the position shown in FIGS. 1–3 to the position shown in FIG. 4. During this movement, the support arms 112 and 113 pivot clockwise in FIGS. 4 and 9. The spring 132 tends to urge pivotal movement of these parts in this direction. The spring 132 is preferably selected so that it counterbalances most of the weight of the board 136. Thus, a person lifting the board 136 can do so by exerting only a relatively small force on the board at one end thereof. The link 126 ensures that the arms 112 and 113 pivot synchronously, so that the ends of the board 136 move upwardly by the same amount and at the same time.

Once the board 136 has been raised to the position shown in FIG. 4, it is pivoted 90° about the cylindrical pins 166 from the position shown in solid lines in FIG. 8 to the position shown in broken lines in FIG. 8 and in solid lines in FIG. 5. It will be noted from FIG. 5 that the shallow groove 159 in the underside of the board 136 receives the top rail 61 of the collapsed side rail 24, so that the side rail 24 provides solid support for the left end of the support board 136. As previously mentioned with reference to FIG. 2, the central portion 73 of the bent end spindle 53 is at the same height as the top rail 61 in the collapsed position of the side rail 24, and thus also engages the shallow groove in the underside of the support board 36 and helps to provide support for the board 136. Further, the projections 76 on the spindle supports 47–50 in FIG. 2 each support a respective spindle at a location adjacent its pivotal connection to the top rail 61, so that the top rail 61 is itself solidly supported and will not tend to have any vertical play when downward forces are exerted onto it from the support board 136. The semicircular recesses in the projection 26 each receive a respective one of the spindles, and prevent transverse movement of the top rail 61 which in turn, through cooperation with groove 159, prevents transverse movement of support board 136.

It should be noted that the movement of the support board 136 from its retracted position to its operational position can be carried out when the stretcher 10 and the other bed or stretcher are in a close side-by-side relationship, without any need to jockey the relative positions of the stretchers.

When the board 136 is in the position shown in FIG. 5, the top surface thereon is substantially flush with and adjacent to the top surface 18 on mattress 17, and the rounded end portion 146 ensures that, as a patient is slid from the mattress 17 across the board 136 to the other mattress 204, there are no sharp edges on the board 136 which could snag the patient, the patient's bed clothes or any sheet being moved with the patient. The downwardly inclined edge portion 147 of the board 136 tends to depress and thus grip the top surface of the mattress 204, which helps to resist any tendency for the mattresses 17 and 204 to move apart, and also facilitates movement of a patient onto and across the board 136 when the patient is being moved in the opposite direction (from the mattress 204 to the mattress 17). The patient's weight tends to contribute to the gripping effect of the edge portion 147. The ABS board 136 has an inherently low coefficient of friction which facilitates the patient transfer.

After the patient has been transferred, the board 136 is manually pivoted 90° back to the position shown in FIGS. 4 and 8, in which, as shown in FIG. 8, the top surface 177 on each stop 174 engages the inner end of the associated rectangular recess 153 in the main board part 141, thereby preventing pivotal movement of the board 136 past the position shown in FIGS. 4 and 8, and thereby preventing the board 136 from falling onto and possibly injuring the patient. The board may then be manually lowered to the original position shown in FIGS. 1–3, or may simply be released and allowed to drop to its original position as a result of the force of gravity, the counterbalancing effected by the spring 132 ensuring that the downward movement of the board is relatively gentle. In this original position, as best seen in FIGS. 3 and 9, the end portions 119 of the support arms 112 and 113 engage the stops 41 and 42 on the stirrups 38 and 39, to prevent further downward movement of the board 136. However, it should be noted that the end portions 119 of the support arms 112 and 113 are each parallel to and disposed against a lower edge of the board 136 in this lowered position. Consequently, and as mentioned earlier, the stirrups 38 and 39 could in fact be omitted, in which case the engagement of the edge of the board 136 with the end portions 119 of the arms 112 and 113 would serve to prevent downward movement of the board 136 beyond the position shown in FIGS. 3 and 9.

The board 136 can be moved to the position of FIG. 5 even when the vehicle 10 is not adjacent another vehicle or bed, in which case the board will be cantilevered because the edge portion 147 will not be disposed on another mattress. The board 136 could then be used for purposes other than transferring a patient onto or off of the vehicle 10. For example, the arm of a patient lying on the mattress 17 could be placed on the support board 36 during insertion into the arm of an intravenous needle, and could thereafter be maintained on the board 136 while the intravenous needle remains in the arm.

Turning now to the alternative embodiment of FIG. 10, operation is substantially the same as that described above for the embodiment of FIG. 1, except that the embodiment of FIG. 10 has no link member coupling the support arms 188 and 189 to force them to pivot synchronously, and has no spring producing a force to counterbalance the weight of the support board 187. However, since the support board 187 is shorter and lighter than the support board 136 of the embodiment of FIG. 1, the support board 187 of FIG. 10 is easier to manually maneuver and thus a link and a counterbalance are not necessary. The board 186 of FIG. 10 is intended primarily for purposes such as supporting a patient arm during the insertion of an intravenous needle. However, the board 186 of FIG. 10 can be used to effect a patient transfer in substantially the same manner as the support board 136 in the embodiment of FIG. 1, in particular by sliding the patient's torso and head across the support board 186 while manually supporting the feet of the patient.

Preferred embodiments of the invention have been disclosed in detail for illustrative purposes, but it will be recognized that variations or modifications of the disclosed devices, including the rearrangement of parts, lie within the scope of the present invention.

The embodiments in which an exclusive property or privilege is claimed are defined as follows:

1. An apparatus comprising: a vehicle having an upwardly facing surface; a support member having thereon a support surface; and support means supporting said support member on said vehicle for movement between a retracted position in which said support member is disposed below said surface on said vehicle and an operational position in which said support member is disposed in the region of an edge portion of said surface on said vehicle and is oriented so that said support surface thereon is facing upwardly and is at approximately the same vertical level as said surface on said vehicle, said support surface including a portion which is disposed horizontally outwardly beyond said edge portion of said surface on said vehicle, wherein as said support member moves from said retracted position to said operational position said support means causes said support member to move upwardly adjacent said edge portion of said surface on said vehicle with said support member oriented so that said support surface thereon extends approximately vertically; and wherein said vehicle has a side rail spaced outwardly from said edge portion of said surface on said vehicle and movable between a lowered position in which a top of said side rail is disposed below said surface on said vehicle and a raised position in which said top of said side rail is higher than said surface on said vehicle, said upward movement of said support member with said support surface thereon approximately vertical taking place between said side rail and said edge portion of said surface on said vehicle.

2. An apparatus as recited in claim 1, wherein said support member has an edge portion which rests on said top of said side rail when said support member is in said operational position and said side rail is in said lowered position.

3. An apparatus as recited in claim 2, wherein said support member has a shallow groove therein, and said top on said guide rail engages said shallow groove when said support member is in said operational position.

4. An apparatus as recited in claim 2, wherein said side rail includes a base rail fixedly supported on said vehicle, a top rail, and a plurality of elongate spindles which each have one end pivotally supported on said bottom rail and a further end pivotally coupled to said top rail, one of said spindles located at one end of said side rail having a portion which, in said lowered position of said side rail, engages and supports a portion of said support member.

5. An apparatus as recited in claim 2, wherein said support means supports said support member for pivotal movement about a substantially horizontal axis which extends approximately parallel to said edge portion of said surface on said vehicle and which is provided near an edge of said support member closest to said surface on said vehicle when said support member is in said operational position, said support member being pivotal about said axis between said operational position in which said support surface on said support member is approximately horizontal and an upright position in which said support surface on said support member extends approximately vertically.

6. An apparatus as recited in claim 1, wherein when said support member is in said retracted position said support surface thereon extends substantially vertically and said support member is located between said side rail and a portion of said vehicle having said support surface thereon.

7. An apparatus as recited in claim 1, wherein said support member has an edge portion which, when said support member is in said operational position, is remote from said support surface on said vehicle and is inclined to extend downwardly and away from said surface on said vehicle.

8. An apparatus as recited in claim 1, wherein said support means includes means supporting said support member for pivotal movement about a horizontal axis located in the region of an edge portion of said support member, said edge portion of said support member being located in the region of said edge portion of said surface on said vehicle when said support member is in said operational position.

9. An apparatus comprising: a vehicle having an upwardly facing surface; a support member having thereon a support surface; and support means supporting said support member on said vehicle for movement between a retracted position in which said support member is disposed below said surface on said vehicle and an operational position in which said support member is disposed in the region of an edge portion of said surface on said vehicle and is oriented so that said support surface thereon is facing upwardly and is at approximately the same vertical level as said surface on said vehicle, said support surface including a portion which is disposed horizontally outwardly beyond said edge portion of said surface on said vehicle; and wherein said support means includes means for substantially counterbalancing the weight of said support member.

10. An apparatus as recited in claim 9, wherein as said support member moves from said retracted position to said operational position, said support means causes said support member to move upwardly adjacent said edge portion of said surface on said vehicle with said support member oriented so that said support surface thereon extends approximately vertically.

11. An apparatus comprising: a vehicle having an upwardly facing surface; a support member having thereon a support surface; and support means supporting said support member on said vehicle for movement between a retracted position in which said support member is disposed below said surface on said vehicle and an operational position in which said support member is disposed in the region of an edge portion of said surface on said vehicle and is oriented so that said support surface thereon is facing upwardly and is at approximately the same vertical level as said surface on said vehicle, said support surface including a portion which is disposed outwardly in a horizontal direction beyond said edge portion of said surface on said vehicle; wherein said support means includes two separate support arms which each have a first end supported on said vehicle for pivotal movement about a respective pivot axis and which each have a second end pivotally coupled to said support member.

12. An apparatus as recited in claim 11, wherein said pivot axes of said support arms are spaced and substantially parallel, and each extend approximately parallel to said horizontal direction.

13. An apparatus as recited in claim 12, including a link which extends between and is pivotally coupled to each of said support arms at locations spaced radially from the pivot axes of said support arms, said link forcing said support arms to pivot synchronously.

14. An apparatus as recited in claim 13, wherein said support means includes means for substantially counterbalancing the weight of said support member.

15. An apparatus as recited in claim 14, wherein said means for counterbalancing includes an expansion spring having one end coupled to said vehicle and a further end coupled to said link.

16. An apparatus as recited in claim 11, wherein each said support arm includes a first portion which extends coaxially with said pivot axis thereof and is rotatably supported on said vehicle, a second portion extending radially outwardly from an end of said first portion, a third portion extending outwardly from a radially outer end of said second portion substantially parallel to said first portion, and a fourth portion extending outwardly from an end of said third portion remote from said second portion, each said support arm being pivotally coupled to said support member at end of said fourth portion thereof remote from said third portion thereof.

17. An apparatus as recited in claim 16, wherein when said support member is in said retracted position, said fourth portion of each said support arm extends substantially parallel to and engages an edge surface of said support member.

18. An apparatus as recited in claim 11, wherein said support means includes at said second end of each said support arm a support part which is supported on said second end of such support arm for pivotal movement about an axis extending substantially parallel to the pivot axis of such support arm, said support member being coupled to each said support part for pivotal movement relative thereto about a common horizontal axis extending substantially perpendicular to said pivot axes of said support arms.

19. An apparatus as recited in claim 11, wherein said support means includes at said second end of each said support arm a support portion which moves approximately vertically in response to pivotal movement of such support arm and which has two coaxial pivot pin portions extending outwardly therefrom in opposite directions, said support means further including said support member having first and second parts which are fixedly secured to each other, said first part having spaced first and second recesses in an edge portion thereof and having in a surface thereof disposed against said second part two pairs of grooves, said grooves of each said pair communicating with and extending outwardly in opposite directions from a respective one of said first and second recesses, each said support part extending into a respective said recess and said pivot pin portions on each said support part being respectively rotatably disposed in said grooves of a respective said pair.

20. An apparatus as recited in claim 19, wherein said support part has thereon a stop which is engageable with said support member to limit pivotal movement of said support member relative to said support part.

21. An apparatus as recited in claim 20, wherein said support part is a vertically extending platelike member having a cylindrical rod welded to an upper edge thereof, said pivot pin portions being respective end portions of said rod.

22. An apparatus as recited in claim 21, wherein said stop is a piece of metal welded on one side of a central portion of said rod.

23. An apparatus as recited in claim 22, wherein each said platelike member is supported on said second end of a respective said support arm for pivotal movement about a horizontal axis extending substantially parallel to the pivot axis of such support arm.

24. An apparatus as recited in claim 19, wherein said first and second parts of said support member are adhesively secured to each other.

25. An apparatus as recited in claim 11, wherein when said support member is in said retracted position said support member substantially visually conceals said support arms.

26. An apparatus comprising: a vehicle having an upwardly facing surface; a support member having thereon a support surface; and support means supporting said support member on said vehicle for movement between a retracted position in which said support member is disposed below said surface on said vehicle and an operational position in which said support member is disposed in the region of an edge portion of said surface on said vehicle and is oriented so that said support surface thereon is facing upwardly and is at approximately the same vertical level as said surface on said vehicle, said support surface including a portion which is disposed horizontally outwardly beyond said edge portion of said surface on said vehicle, wherein as said support member moves from said retracted position to said operational position said support means causes said support member to move upwardly adjacent said edge portion of said surface on said vehicle with said support member oriented so that said support surface thereon extends approximately vertically; wherein said support means includes two support arms which each have one end pivotally supported on said vehicle and have an opposite end pivotally coupled to said support member; and including a link which extends between and is pivotally coupled to each of said support arms at locations spaced radially from the pivot axes of said support arms, said link forcing said support arms to pivot synchronously.

27. An apparatus comprising: a vehicle having an upwardly facing surface thereon; a support member having a support surface thereon; and support means cooperable with an edge portion of said support member for facilitating movement of said support member between a retracted position in which said support member is disposed vertically lower than said surface on said vehicle and an operational position in which said edge portion of said support member is adjacent an edge portion of said surface on said vehicle and in which said support surface on said support member is substantially horizontal, faces upwardly and extends from said edge portion of said support member horizontally outwardly away from said edge portion of said surface on said vehicle; wherein said support means includes means supporting said support member for pivotal movement about a horizontal axis located in the region of said edge portion of said support member; and wherein said support means includes a side rail on said vehicle which engages an underside of said edge portion of said support member when said support member is in said operational position, said pivot axis being disposed between said side rail and said edge portion of said surface on said vehicle when said support member is in said operational position.

28. An apparatus comprising: a vehicle having thereon an upwardly facing surface, and first and second side rails which are provided on opposite sides of said surface and which project upwardly beyond said surface, each said side rail having at one end a handle portion which can be manually gripped and which is inclined to extend downwardly and away from said side rail; wherein each of said first and second side rails includes a bottom rail fixedly supported on said vehicle, a top rail, and a plurality of spindles which each have a first end pivotally supported on said bottom rail and a second end pivotally supported on said top rail, each said side rail being movable between a raised position in which said side rail projects upwardly beyond said surface on said vehicle and a lowered position in which said side rail is disposed lower then said surface on said vehicle, said handle portion of each said side rail being a portion of one of said spindles.

29. An apparatus as recited in claim 28, wherein each said spindle having said handle portion thereon is a bent rod having a straight central portion connecting two straight end portions which each extend at an angle with respect to said central portion, the ends of said end portions remote from said central portion each being pivotally coupled to a respective one of said bottom rail and said top rail, said end portion pivotally coupled to said top rail being said handle portion of said side rail.

* * * * *